United States Patent [19]

Adell

[11] Patent Number: 4,658,523

[45] Date of Patent: Apr. 21, 1987

[54] COLLECTIBLE

[75] Inventor: Robert Adell, Novi, Mich.

[73] Assignee: U.S. Product Development Company, Sunnyvale, Tex.

[21] Appl. No.: 378,310

[22] Filed: May 14, 1982

[51] Int. Cl.[4] ..... G09F 11/00

[52] U.S. Cl. ..... 40/1; 40/334

[58] Field of Search ..... 40/1, 334; 401/152

[56] References Cited

U.S. PATENT DOCUMENTS

| | | | |
|---|---|---|---|
| D. 155,152 | 9/1949 | Greenstein | D19/46 |
| D. 246,530 | 11/1977 | Zeischegg | D19/46 |
| D. 266,007 | 8/1982 | Salinger | D19/42 |
| 405,102 | 6/1889 | Kraus | 40/334 |
| 1,305,245 | 6/1919 | Barthelemy | 40/334 |
| 3,615,596 | 10/1971 | Petti | 401/152 |
| 3,949,506 | 4/1976 | Benkowski | 40/160 |

FOREIGN PATENT DOCUMENTS

| | | | |
|---|---|---|---|
| 1006754 | 4/1957 | Fed. Rep. of Germany | 40/334 |

*Primary Examiner*—Gene Mancene
*Assistant Examiner*—Wenceslao J. Contreras
*Attorney, Agent, or Firm*—Rhodes and Boller

[57] ABSTRACT

A collectible comprises a base, a writing instrument removably mounted on the base in an upright position and a replica of a piece of sports equipment mounted on the writing instrument. The disclosed embodiment is of a replica of a football helmet mounted on a pen.

19 Claims, 7 Drawing Figures

COLLECTIBLE

BACKGROUND AND SUMMARY OF THE INVENTION

This invention relates to a collectible such as is collected by hobbyist collectors. More specifically the invention relates to a collectible which embodies a writing instrument such as a pen and which may also be related to sport activities.

Certain types of collectibles involve sports-related articles. Examples of such collectibles are pennants, autographed baseballs, autographed footballs, etc. The stature of a collection is enhanced by collectibles of the same general character but each unique, for example identifying a particular sports team. One can thus collect articles identifying his or her favorite sports team, or teams, and it can also be an objective to collect the entire collection of such articles comprising all possible sports teams.

Many collectibles are simply for display purposes or for the self-satisfaction of the collectors. In other words they often have no utilitarian value by themselves. Children are particularly awed by collectibles, and they often have an intense desire to possess collectible articles relating to their favorite sports team or teams. This can also extend to a full collection of all sports teams. While collecting simply for personal satisfaction is an admirable objective, it is a fact of life that many children and their families are of limited resources and cannot often afford the enjoyment of collections simply for collection's sake. Hence if a collectible has a utilitarian aspect, it is more prone to acceptance by the parents who often are the ones actually purchasing the collectible for the child. This is not to say that children themselves do not purchase collectibles because children may have a weekly allowance which enables them to make purchases; however, it is generally fair to say that their purchasing power is limited. Accordingly, the creation of a collectible which can satisfy the desire of children to acquire collectibles, while at the same time being of a cost which is within their own and/or their parent's reach, is certainly a desirable objective. Furthermore as noted above, when coupled with a utilitarian aspect, this objective becomes even more desirable.

The present invention is directed to a collectible which, in addition to having an inherent collection value of its own, also possesses a utilitarian aspect. Furthermore the cost of the collectible is within the reach of children and their parents, and in many instances it will be possible for children to collect them in numbers rather than simply being able to purchase only a single collectible.

The present invention is directed to a collectible which comprises a base, a writing instrument removably mounted on the base in an upright position, and a replica of a piece of sports equipment mounted on the writing instrument. The replica of the piece of sports equipment and/or the base may contain indicia and/or colors representative of a particular sports team. The disclosed embodiment of the invention uses as a replica of a piece of sports equipment, a replica of a football player's helmet. The helmet is mounted on one end of the writing instrument, and an aperture is provided in the base into which the other end of the writing instrument is inserted. The illustrating embodiment of writing instrument is a pen, such as a felt tip pen, and it comprises a body containing the felt tip which is covered by a removable cap. The helmet replica is mounted on the cap. Thus the collectible may be displayed on a display surface such as a desk, shelf, or the like, and the collectible helmet will be supported by the pen at a location above the base so that indicia on both the base and the helmet may be readily viewed. If desired, the pen may be removed from the base for use by an individual. The pen cap, with helmet attached, is removed to expose the felt writing tip on the pen body, and the removed cap may either be placed on the end of the pen body opposite the tip or else it may be set aside. After use the pen is re-capped, and may be returned to the base for display. The colors involved for the helmet and base may relate to the identity of a particular sports team and it is possible to coordinate the color of the pen therewith. Thus a set of collectibles contemplates not only the complete range of individual teams, but it encompasses various colors of pens as well.

The collectible can be manufactured and sold at retail at a very reasonable cost, and thus the enjoyment of a collection, such as a sports team collection, is within the reach of children, who for the most part possess limited resources for purchasing collectibles.

Further features of the invention relate to the details of construction, and these contribute to the capability to manufacture the collectibles at reasonable cost.

The foregoing features, advantages, and benefits of the invention, along with additional ones, will be seen in the ensuing description and claims which should be considered in conjunction with the accompanying drawings. The drawings disclose preferred embodiments of the invention according to the best mode contemplated at the present time in carrying out the invention.

DESCRIPTION OF THE PREFERRED EMBODIMENT

Figure 1:
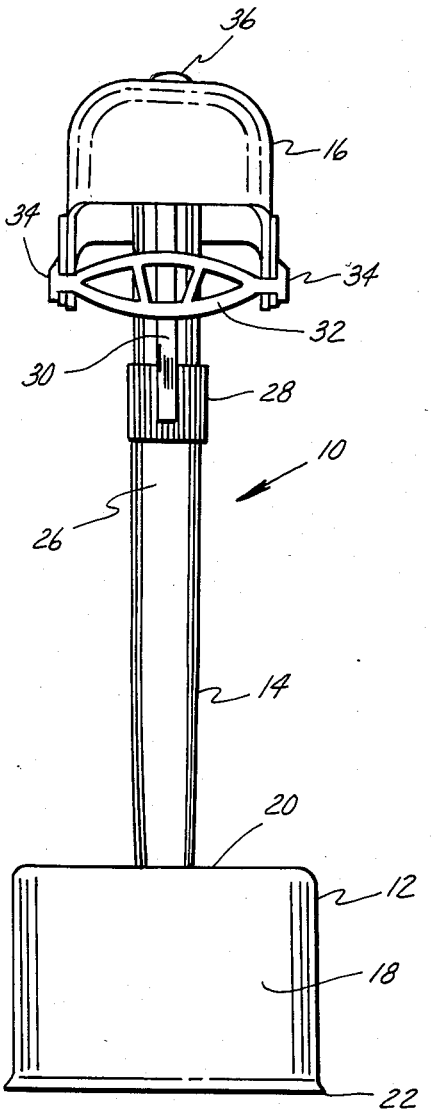
FIG. 1 is a front elevational view of a collectible embodying principles of the present invention.
Figure 2:
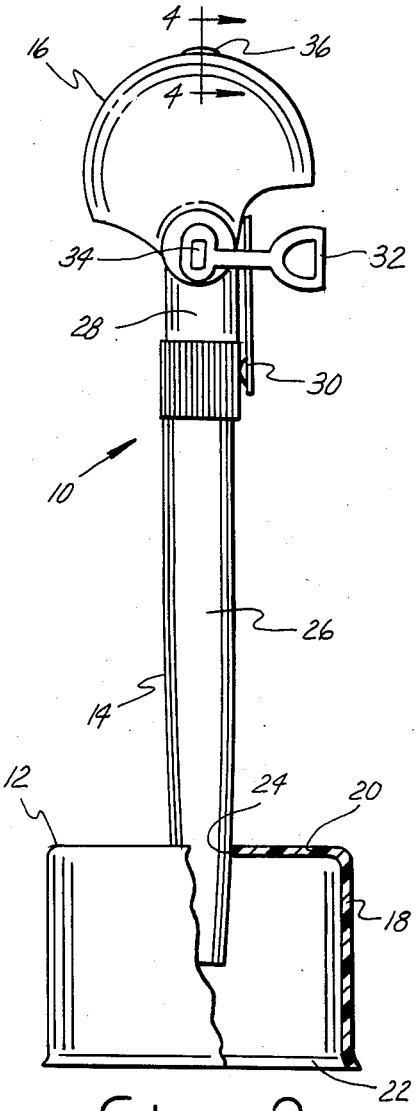
FIG. 2 is a left side elevational view of the collectible of FIG. 1 having a portion broken away.
Figure 3:
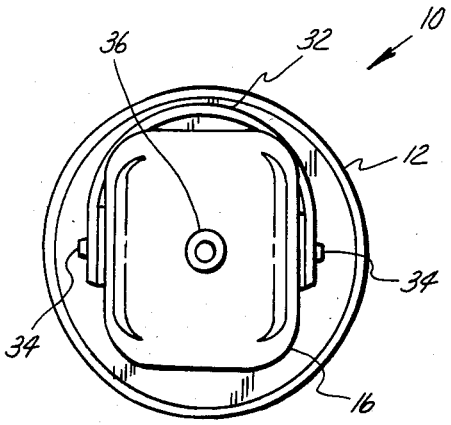
FIG. 3 is a top view of the collectible of FIG. 1.

FIG. 1 illustrates a first embodiment of collectible 10 embodying principles of the present invention. The collectible 10 comprises base 12, a writing instrument 14, and a replica of a piece of sports equipment 16. Base 12 is preferably a plastic member comprising a circular cylindrical side wall 18 and a circular horizontal top wall 20. It includes an outwardly turned bottom lip 22 via which the base rests on a display surface. A circular hole 24 is provided centrally in top wall 20 and the lower portion of the writing instrument 14 is inserted into hole 24. The diameter of the hole 24 is such in relation to the diameter of the writing instrument that the base supports the writing instrument in the manner shown in FIG. 2.

Writing instrument 14 is illustrated as a pen, preferably a tipped marking pen of the type which is commonly used today. The pen comprises a generally cylindrical body 26 with the writing tip being covered by a removable cap 28. A pocket clip 30 is often affixed to the cap allowing the instrument to be clipped onto one's pocket. Thus in the illustrated configuration of FIGS. 1 and 2 the tip of the pen (which cannot be viewed because it is covered by the cap) is pointing upwardly and it is the opposite end of the body 26 which is inserted into base 12.

The illustrated replica of a piece of sports equipment 16 comprises a helmet mounted on the writing instrument 14. The illustrated example is a football helmet including a replica of a face mask 32. The helmet is preferably a molded plastic article and the face guard may be a separate plastic article which is removably secured to the ear pieces of the helmet via tabs and slots indicated generally by the reference numeral 34.

Figure 4:
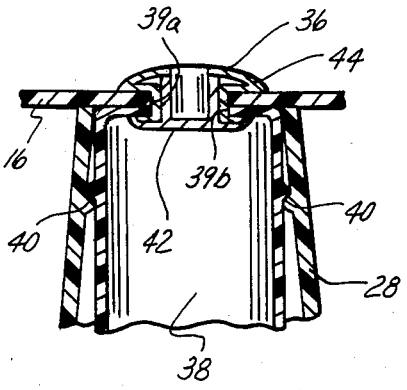
FIG. 4 is an enlarged fragmentary cross sectional view taken substantially in the direction of arrows 4—4 in FIG. 2.

The helmet and pen cap are secured together in the collectible 10 by means of a separate attaching element 36. The illustrated embodiment of attaching element 36 is in the form of a pop rivet. The construction of the pen cap is such that disposed within it is a separate insert 38 (see FIG. 4). This separate insert is lodged to interlock in the cap by means of interfering protuberances indicated generally at 40. The illustrated construction has protuberances on the outer wall of the insert and on the inner wall of the cap. Thus, once the insert is pushed fully into the cap from the end which fits onto body 26, it locks in place so as to remain with the cap and close the narrower, upper end of the cap.

The lower end of the insert 38 is open for engagement with the pen body 26 so as to enclose the writing tip in a generally sealed relation which prevents air from drying out the writing tip. The attachment of helmet 16 to cap 28 is accomplished by drilling aligned holes **39*a*, 39*b*, in the top of the helmet and in the upper end of the insert 38. With the helmet disposed on the cap and the holes in alignment, a pop rivet is inserted from the outside of the cap passing through holes 39*a*, 39*b*. The tool associated with the pop rivet is then used to deform the rivet so that the interior portion of the rivet mushrooms into the shape indicated at 42 with the result that the helmet and the cap are tightly secured together between the mushroomed portion 42 and the head 44** which is on the outside of the helmet. In this way the helmet is suitably secured to the cap so as to remain joined to the cap when the cap is removed.

In the collectible 10, the pen is readily removable from the base for writing use. The pen cap and integrally attached helmet are removed from the pen body 26 to expose the writing tip. The pen cap and integrally attached helmet may be set aside or else the cap may be placed onto the end of the pen body opposite the writing tip in the usual manner. One can imagine the delight of a child using the writing instrument with the helmet replica displayed for view, especially where it can be seen by peers. At other times the pen is replaced on the base for display purposes with the cap and helmet in place. One can also imagine the pleasure of a child having the collectible in his room where it is displayed for view.

Figure 5:
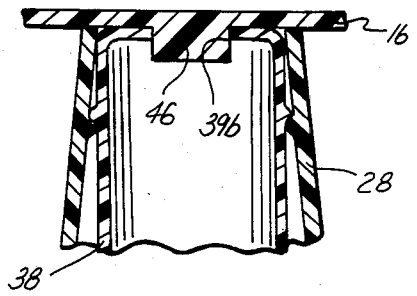
FIGS. 5 and 6 are views similar to FIG. 4 of fabrication steps in fabricating an alternate construction.
Figure 6:
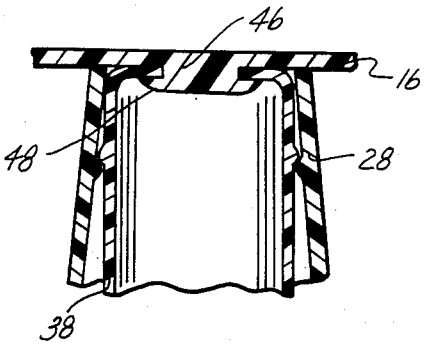

FIGS. 5 and 6 illustrate an alternate construction for mounting of the helmet to the pen cap 28. In this construction the helmet is formed with an integral cylindrical circular projection 46 centrally on the inside of the helmet. The projection is sized to fit into the hole **39*b* in the pen cap insert 38 and to extend beyond it a certain distance as seen in FIG. 5. Through the use of an assembly technique such as ultrasonic welding the integral projection can be deformed into a mushroom shape 48 as seen in FIG. 6** to thereby complete the attachment. This is a particularly useful technique for it eliminates the use of the pop rivet and there is no separate attaching element whose head is visible at the top of the helmet as is the case with the pop rivet.

Figure 7:
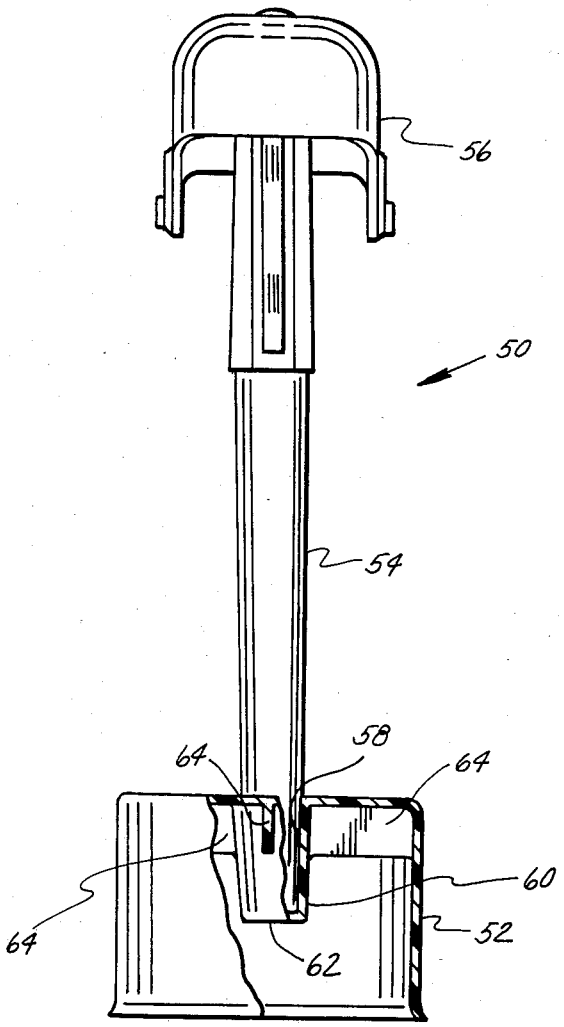
FIG. 7 is a front elevational view of another embodiment of collectible.

FIG. 7 illustrates a further embodiment of collectible 50 having a base 52, a writing instrument 54, and a replica of a helmet 56. The helmet replica 56 is like that of the embodiment 10 except that the face mask 32 is omitted. The writing instrument while of the same general construction has a somewhat different appearance.

The base 52 differs from base 12 in that it is constructed with a central tapered receptacle 58. The receptacle 58 comprises a tapered side wall 60 and a bottom wall 62 with the receptacle being open at the top so as to allow the lower end of the writing instrument to be inserted. The tapered receptacle is designed to engage the end of the pen body so as to support the pen in an upright position. Reinforcement for the receptacle is provided by the inclusion by a plurality of reinforcing ribs 64 disposed around the receptacle at appropriate locations (i.e. such as at 90° intervals) and which bridge between the top wall of the base, the sidewall of the base, and the sidewall of the receptacle. The basic arrangement is the same in that the writing instrument is supported in an upright position on the base, and the writing instrument supports the replica.

In order to promote further enjoyment, it is desirable to include indicia on either or both the base and the replica of sport equipment (i.e. the helmet). Such indicia may take the form of the name and/or logo of a particular sports team. It may be applied to the collectible by any suitable means such as by hot stamping, or by means of decals, or by other means.

The base and helmet may also be provided with particular color or colors which may be representative of a particular team's color or colors. Color may be imparted to the material in the manufacturing process. Where the construction is of plastic, the color may be embodied in the plastic itself. The pens or writing instruments will also preferably be color-coordinated with the colors of the base and/or helmet. Thus a set of collectibles will comprise different colored writing instruments or pens. These can have a particular outward colored appearance as well as being capable of writing in particular colors. Thus the invention provides a collection which not only is of interest for the sake of collecting, but which also has definite utilitarian aspects; for example, a collection of different colored writing instruments can also be collected. One will perceive that the invention provides a product which can satisfy the desire of children to collect articles relating to their favorite team or teams and because of its utilitarian aspect it provides a further benefit which can be appreciated perhaps more so by parents who often are the ones who pay for the purchase.

While preferred illustrated constructions have been disclosed, it will be appreciated that other constructions and methods are contemplated within the scope of the invention. It is entirely possible to use other means for securing the helmet to the pen, such as by use of a suitable cement, by an integral molding of the cap and the helmet, by threaded fasteners, staking, fusing, etc. While plastic is certainly the preferred material for the base and helmet, it will be appreciated that other materials could certainly be used. For example, wood, metal, ceramic, or other types of materials could be used in the practice of the invention. Also it should be pointed out that it is not absolutely essential that a team name and/or logo be used in connection with the collectible. Thus it is entirely possible that the collectibles can be vended without any indicia or logo, leaving it to the collector to decorate the collectible as he sees fit.

What is claimed is:

1. A collectible comprising a base, a writing instrument removably mounted on the base in an upright position, said writing instrument comprising an elongate body having one end engaging the base and a writing tip at the opposite end, a cap separably engaging the body to cover the writing tip, and a replica of a piece of sports equipment mounted on the cap wherein said replica of a piece of sports equipment comprises a replica of a sport player's protective headgear with the inside of the headgear fitting onto the cap.

2. A collectible as set forth in claim 1 wherein said writing instrument comprises a pen, said base comprising an aperture, said one end being removably inserted into the aperture.

3. A collectible as set forth in claim 2 wherein said base includes a receptacle associated with said aperture for supporting the writing instrument.

4. A collectible as set forth in claim 2 in which said base comprises a circular shape having a circular top wall and a circular sidewall extending downwardly from the perimeter of said top wall and in which said aperture is centrally located in said top wall.

5. A collectible as set forth in claim 4 including indicia on at least one of said replica of a sport player's protective headgear and the sidewall of said base for correlating with a particular sports team.

6. A collectible as set forth in claim 1 wherein said base comprises a member having side and top walls and including an aperture in the top wall via which the writing instrument removably mounts on the base.

7. A collectible as set forth in claim 6 including a receptacle in said base extending from said aperture with the writing instrument passing through the aperture and being supported by the receptacle.

8. A collectible as set forth in claim 7 in which integral ribs assist in supporting the receptacle from the top and side walls of the base.

9. A collectible as set forth in claim 1 including indicia on at least one of said base and said replica of a piece of sports equipment for correlating with a particular sports team.

10. A collectible as set forth in claim 9 in which said indicia is disposed on both said base and said replica of a piece of sports equipment.

11. A collectible comprising a base, a writing instrument removably mounted on the base in an upright position, said writing instrument comprising an elongate body having one end engaging the base and a writing tip at the opposite end, a cap separably engaging the body to cover the writing tip, and a replica of a piece of sports equipment mounted on the cap wherein said replica of a piece of sports equipment comprises a replica of a football player's helmet with the inside of the helmet replica fitting onto the cap.

12. A collectible as set forth in claim 11 in which the football helmet replica is attached at a central region thereof to the cap and including a separate fastening element which is used to secure the helmet replica to the cap.

13. A collectible as set forth in claim 11 in which the football helmet replica is attached at a central region thereof to the cap and in which the attachment of the helmet replica to the cap is provided by an aperture in the cap with an integral projection on the helmet replica passing through the aperture and being deformed to join the cap and the helmet replica together.

14. A collectible as set forth in claim 11 including indicia on both said base and said helmet replica for correlating with a particular sports team.

15. A collectible comprising a writing instrument, said writing instrument comprising an elongate body having a writing tip at one end, a cap separably engaging the body to cover the writing tip, and a replica of a piece of sports equipment mounted on the cap wherein said replica of a piece of sports equipment comprises a replica of a sport player's protective headgear with the inside of the headgear fitting onto the cap.

16. A collectible as set forth in claim 15 in which the replica is a replica of a piece of sports headgear attached to the writing instrument.

17. A collectible comprising a writing instrument, said writing instrument comprising an elongate body having a writing tip at one end, a cap separably engaging the body to cover the writing tip, and a replica of a piece of sports equipment mounted on the cap, in which said cap includes an insert forming a closure for one end of the cap, a hole through the insert and means mounting the replica of a piece of sports equipment on the cap via the hole through the insert.

18. A collectible comprising a writing instrument, said writing instrument comprising an elongate body having a writing tip at one end, a cap separably engaging the body to cover the writing tip, and a replica of a piece of sports equipment mounted on the cap, wherein said replica of a piece of sports equipment comprises a replica of a football player's helmet with the inside of the helmet fitting onto the cap.

19. A collectible as set forth in claim 17 wherein the helmet replica attaches at a central region thereof to the cap.

* * * * *

UNITED STATES PATENT AND TRADEMARK OFFICE

CERTIFICATE OF CORRECTION

PATENT NO. : 4,658,523

DATED : April 21, 1987

INVENTOR(S) : Robert Adell

It is certified that error appears in the above-identified patent and that said Letters Patent are hereby corrected as shown below:

Column 6, line 52, "17" should read --18--.

Signed and Sealed this

Eighteenth Day of August, 1987

*Attest:*

DONALD J. QUIGG

*Attesting Officer*

*Commissioner of Patents and Trademarks*